United States Patent [19]

May et al.

[11] 4,418,110

[45] Nov. 29, 1983

[54] VAPOR-PERMEABLE RETROREFLECTIVE SHEETING

[75] Inventors: David C. May, Stillwater; Terry R. Bailey, Woodbury, both of Minn.

[73] Assignee: Minnesota Mining and Manufacturing, St. Paul, Minn.

[21] Appl. No.: 390,636

[22] Filed: Jun. 21, 1982

[51] Int. Cl.[3] ..... G09F 13/16; G09F 13/06

[52] U.S. Cl. ..... 428/143; 156/221; 428/144; 428/402; 428/403; 428/913

[58] Field of Search ..... 428/143, 144, 148, 402, 428/403, 404, 406, 407, 913; 156/221

[56] References Cited

U.S. PATENT DOCUMENTS

| | | | |
|---|---|---|---|
| 3,802,944 | 4/1974 | Tung | 428/143 |
| 4,032,681 | 6/1977 | Jonnes | 428/253 |
| 4,348,312 | 9/1982 | Tung | 428/144 |

*Primary Examiner*—William J. Van Balen

*Attorney, Agent, or Firm*—Donald M. Sell; James A. Smith; Roger R. Tamte

[57] ABSTRACT

Retroreflective sheeting in which a specularly reflective layer within the sheeting has extensive discontinuities which make the sheeting permeable to vapor, thereby allowing release of vapors from a substrate to which the sheeting is applied.

17 Claims, 1 Drawing Figure

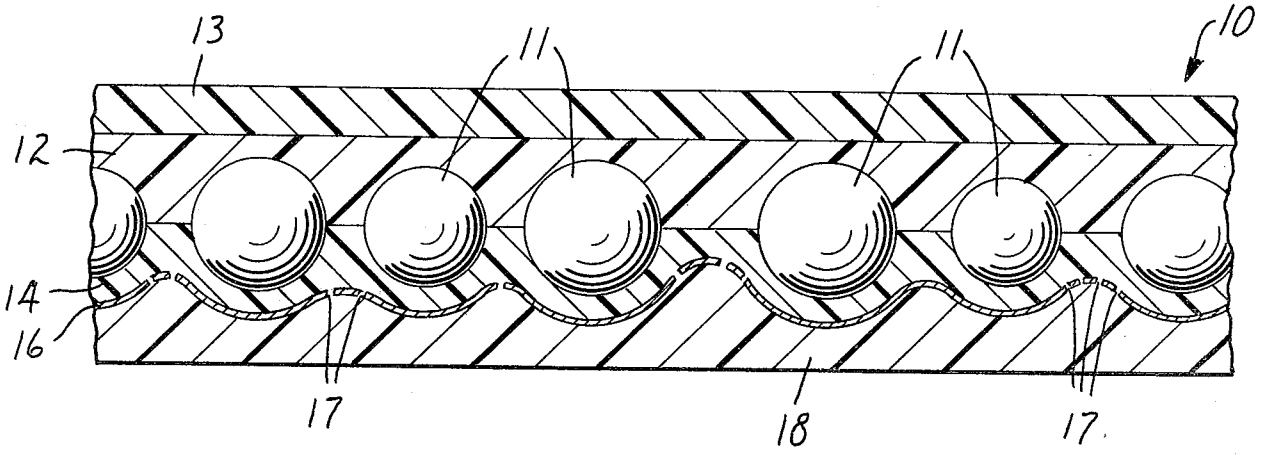
10
11
11
13
12
14
16
17
17
18

VAPOR-PERMEABLE RETROREFLECTIVE SHEETING

BACKGROUND OF THE INVENTION

Retroreflective sheeting is sometimes adhered to painted surfaces, polymeric articles, or other substrates from which gaseous vapors evolve after the sheeting has been adhered in place. Such vapor evolution has caused blistering of prior-art reflective sheeting, especially when the vapor has evolved rapidly or in large volumes, leaving the sheeting with an unsightly appearance and creating a source of delamination, tearing, or other failure of the sheeting.

Prior-art retroreflective sheeting is rather thick and comprises several layers, and all of these layers undoubtedly contribute to inhibiting migration of vapors. However, our experiments reveal that a metallic specularly reflective layer included in the sheeting is a primary cause of the blistering. Sheeting made without the metallic layer allows sufficient migration of vapors to avoid the previously experienced blistering.

However, retroreflective sheeting made without a metallic specularly reflective layer underlying the transparent microspheres also provides a very low level of retroreflection. A specularly reflective layer is essential, and the blistering problem must be avoided while still retaining such a layer. Insofar as known, no one has previously taught how to do that.

SUMMARY OF THE INVENTION

The present invention provides a new vapor-permeable retroreflective sheeting. This new sheeting is similar to previous sheetings in that it includes a monolayer of transparent microspheres, a metallic specularly reflective layer underlying and in optical connection with the microspheres, usually a transparent spacing layer disposed between the microspheres and specularly reflective layer (to position the specularly reflective layer at the approximate focal point of light transmitted by the microspheres), one or more layers of transparent binder material to support the microspheres or form a flat top surface for the sheeting, and usually an adhesive layer for adhering the sheeting to a substrate.

The new sheeting is distinctive from previous sheetings in that the metallic specularly reflective layer has an extensive array of minute discontinuities such as fracture lines formed by stretching the layer. The discontinuities in the layer are very small and constitute a small percentage of the total area of the layer, but it has been found that vapors migrate through such discontinuities rapidly enough to greatly reduce or avoid the blistering exhibited by conventional reflective sheeting products. Also, despite the discontinuities, the reflectivity of the sheeting is not noticeably affected, and the product remains physically strong and durable.

Stretching of the metallic specularly reflective layer to fracture it is a preferred method for forming discontinuities, and preferred steps of such a stretching operation include (a) preparing a stretchable intermediate-stage product, which usually comprises at least a monolayer of transparent microspheres, a transparent spacing layer underlying and in optical connection with the microspheres, and a thin metallic specularly reflective layer carried on the bottom surface of the spacing layer; and (b) stretching the intermediate-stage product, as in tentering apparatus, so as to fracture the metallic specularly reflective layer and form the described array of discontinuities.

Other components are typically added after the stretching operation. For example, one or more layers of transparent polymeric material can be added to the top of the product, forming a smooth top surface, and leaving the sheeting capable of reflecting when either wet (as with rain or other moisture) or dry; and one or more layers, typically including an adhesive layer, can be added at the bottom.

After completion, the new retroreflective sheeting is sufficiently permeable that water vapor will pass through the sheeting at a rate of at least 15, and preferably at least 20, grams/square meter/24 hours. (In making this measurement, the test sheeting is placed as a membrane separating two sealed chambers, one of which is maintained at a temperature of 72° F. and a relative humidity of 90 percent, and the other of which is maintained at a temperature of 72° F. and a relative humidity of zero percent. The second chamber contains a water vapor sorbent, which is weighed before and after the period of testing, and the rate of water vapor transmission is calculated from the measured difference in weight.) By contrast, under the same conditions water vapor will pass through conventional retroreflective sheeting at a rate of about 6 grams/square meter/24 hours.

DESCRIPTION OF THE DRAWINGS

The drawing is an enlarged sectional view through a representative reflective sheeting of the invention.

DETAILED DESCRIPTION

The sheeting 10 shown in the drawings comprises a layer of transparent microspheres 11; a layer 12 of transparent binder material in which the microspheres are supported essentially as a monolayer; a transparent top layer 13; a transparent spacing layer 14 having a bottom surface which generally follows the contour of the bottom of the microspheres, and which is spaced from the microspheres at the approximately focal point for light rays impinging on the front of the reflective sheeting and passing through the microspheres; a specularly reflective layer 16, which is carried on the contoured surface of the spacing layer, and which has an extensive array of minute discontinuities 17; and a bottom layer 18, which most typically is a layer of adhesive such as pressure-sensitive adhesive for adhering the sheeting to a substrate.

Manufacture of the reflective sheeting shown in the drawing typically begins by coating material for forming the top layer 13 onto a carrier web, either from solution or from some other liquefied form, solidifying that material, and then coating material for the binder layer 12. Transparent microspheres are cascaded onto the coated binder layer while the layer is still wet, whereupon the microspheres become partially embedded in the layer. After the coated layer has been dried or otherwise solidified, material for the spacing layer is coated over the microspheres, again either from solution or from some other liquefied form, and solidified. Thereupon the specularly reflective layer is applied to the spacing layer, typically by vapor-deposition of metal.

In contrast to the product shown in the drawings, some products of the invention include no spacing layer. Such products include so-called "exposed-lens" sheeting in which the front surfaces of the microspheres are not embedded in polymeric material but are exposed to air, and sheeting in which the microspheres have a high index of refraction. In these products the specularly reflective layer is directly applied to the rear surface of the microspheres (such an application may be accomplished, for example, while the front surfaces of the microspheres are temporarily held in a removable carrier sheet), and a binder layer is applied over the specularly reflective layer to support the microspheres.

As a next step in the manufacturing process, products as described in the two preceding paragraphs can be subjected to a stretching or tentering operation. Conventional tentering equipment, which stretches the sheet product transversely as it proceeds along the length of the tentering apparatus, is particularly useful. A five-percent expansion of the transverse width of the sheet product is usually sufficient to develop the described array of minute discontinuities, although we prefer to stretch the sheet product 10 percent. Except for the specularly reflective layer, the layers of the stretched product generally elongate and remain intact, and the materials and structure of the product are chosen to achieve that result.

Following the stretching operation, the sheet material is typically allowed to retract, or heated to cause it to retract, so that it usually is no more than about two percent greater than its original dimensions prior to the stretching operation. The sheeting is then completed, as by application of a layer of adhesive, which is typically a pressure-sensitive adhesive, but alternatively can be a heat-activated or solvent-activated adhesive.

Alternative procedures for forming discontinuities in the specularly reflective layer include applying solvent to the described intermediate-stage product so as to cause swelling of the spacing layer, which thereupon results in cracking of the specularly reflective layer; or drawing the intermediate-stage sheet product over a sharp edge so as to fracture the specularly reflective layer; or passing the intermediate stage product through nip rolls under high pressure.

Also, deposition of thinner specularly reflective layers leaves discontinuities sufficient for the noted migration of vapor, and can provide adequate reflection. However, such a procedure is less preferred, since it is difficult to control the operation to reproducibly achieve the desired balance of discontinuities and reflection; and reflection is reduced.

The discontinuities formed in the specularly reflective layer are most often a network of narrow lines, which tend to be concentrated between the microspheres. For most uses of the sheeting the discontinuities should be small in width, so that they are not normally visible to the unaided eye from typical viewing distances of one meter or more. Typically they are less wide than the average diameter of the microspheres in the sheeting.

The various layers in retroreflective sheeting of the invention can be made from conventional materials. For example, a binder layer 12, top layer 13, and spacing layer 14 in a retroreflective sheeting as shown in the drawings are generally made of polymeric materials such as alkyd, vinyl, or acrylic resins; the layer 10 can be a pressure-sensitive-adhesive acrylate copolymer; and the specularly reflective layer can be vapor-deposited aluminum or silver.

The invention will be further illustrated by the following example, which is described with reference to the drawing. An extensible plasticized vinyl resin containing ultraviolet- and heat-stabilizers was coated from solution onto a paper carrier web presized with an alkyd release agent, and the coated layer was heated to fuse it into a 55-micrometer-thick film useful as the top film of the ultimate sheeting. A solution comprising an uralkyd resin and melamine crosslinker was then coated onto the fused top film. After partial drying of the latter layer, transparent glass microspheres having an average diameter of 57 micrometers and an index of refraction of 2.26 were cascaded onto the coated layer as a dense monolayer. The microspheres became partially embedded in the coated layer and partially extended above the coated layer. After curing of the binder layer by heating (leaving a 34.2-micrometer-thick binder layer), a solution comprising a polyvinyl butyral resin and a butylated melamine hardener was coated onto the microspheres to provide the transparent spacing layer 14, which after drying and curing was approximately 19 micrometers thick. Aluminum was vapor-deposited onto the exposed surface of the dried and cured spacing layer to form a metallic specularly reflective layer.

The resulting assembly was stripped from the carrier web and passed through a tentering apparatus at a rate of 10 meters per second, with the assembly being stretched 10 percent at a rate of 4.7 percent per meter forward travel of the sheeting. The assembly was then heated and allowed to return to approximately its original dimensions. The aluminum specularly reflective layer was found to have an extensive array of fractures along lines that generally extended between the microspheres.

The sheeting was then completed by laminating a layer 18 of pressure-sensitive acrylate adhesive onto the discontinuous aluminum layer. The sheeting exhibited a reflectivity of 90 candella per square meter per lux of incident light, and transmitted water vapor through the sheeting at a rate of 24.2 grams per square meter per 24 hours.

What we claim is:

1. Retroreflective sheeting comprising a monolayer of transparent microspheres, a metallic specularly reflective layer underlying and in optical connection with the microspheres, and a transparent polymeric layer in which the microspheres are supported; the specularly reflective layer having an extensive array of minute discontinuities sufficient for the sheeting to transmit water vapor through the sheeting at a rate of at least 15 grams/square meter/24 hours.

2. Retroreflective sheeting of claim 1 in which the discontinuities comprise fractures of an originally continuous specularly reflective layer.

3. Retroreflective sheeting of claim 1 in which the discontinuities comprise fractures of an originally continuous specularly reflective layer concentrated between the microspheres.

4. Retroreflective sheeting of claim 1 in which a smooth-surfaced transparent top layer is disposed over the transparent microspheres.

5. Retroreflective sheeting of claim 1 which transmits water vapor through the sheeting at a rate of at least 20 grams per square meter per 24 hours.

6. Retroreflective sheeting of claims 1, 2, 3, 4, or 5 prepared by stretching the specularly reflective layer to fracture it.

7. Retroreflective sheeting comprising a monolayer of transparent microspheres, a transparent top layer disposed over the microspheres and forming the smooth outer surface of the sheeting, a transparent spacing layer underlying and in optical connection with the microspheres and having a bottom surface spaced from the bottom surfaces of the microspheres, a metallic specularly reflective layer vapor-deposited on the bottom surface of the spacing layer, and a layer of adhesive disposed on the metallic specularly reflective layer; the specularly reflective layer having an extensive array of minute fractures sufficient for the sheeting to transmit water vapor through the sheeting at a rate of at least 15 grams/square meter/24 hours.

8. Retroreflective sheeting of claim 7 in which the fractures are concentrated between the microspheres.

9. Retroreflective sheeting of claim 7 in which the metallic specularly reflective layer comprises aluminum.

10. Retroreflective sheeting of claim 7 which further includes a transparent binder layer disposed between the transparent top layer and transparent spacing layer and in which the transparent microspheres are partially embedded and supported.

11. Retroreflective sheeting of claim 7 which transmits water vapor through the sheeting at a rate of at least 20 grams per square meter per 24 hours.

12. Retroreflective sheeting of claims 7, 8, 9, 10 or 11 prepared by stretching the specularly reflective layer to fracture it.

13. A method for preparing vapor-permeable retroreflective sheeting comprising (A) preparing a stretchable sheet material which comprises a monolayer of transparent microspheres, a transparent layer underlying and in optical connection with the microspheres and having a bottom surface spaced from the bottom surfaces of the microspheres, and a metallic specularly reflective layer carried on the bottom surface of the transparent layer; and (B) stretching said sheet material in at least one direction so as to fracture the metallic specularly reflective layer and form an extensive array of minute discontinuities in the layer.

14. A method of claim 13 in which said sheet material is stretched at least 10 percent to cause said fracturing of the metallic specularly reflective layer.

15. A method of claim 13 in which said sheet material is stretched sufficiently for the sheeting to transmit water vapor through the sheeting at a rate of at least 15 grams per square meter per 24 hours.

16. A method of claim 13 in which a layer of adhesive is applied over the metallic specularly reflective layer after the stretching operation.

17. A method of claim 13 in which a transparent top layer is disposed over the microspheres in the sheeting after the stretching operation.

* * * * *